US009447970B2

(12) United States Patent
Kim et al.

(10) Patent No.: US 9,447,970 B2
(45) Date of Patent: Sep. 20, 2016

(54) COMBUSTOR CASING FOR COMBUSTION DYNAMICS MITIGATION

(75) Inventors: Kwanwoo Kim, Greenville, SC (US); Dheeraj Sharma, Bangalore (IN); Sven Bethke, Niskayuna, NY (US); Yongqiang Fu, Greenville, SC (US)

(73) Assignee: General Electric Company, Schenectady, NY (US)

( * ) Notice: Subject to any disclaimer, the term of this patent is extended or adjusted under 35 U.S.C. 154(b) by 396 days.

(21) Appl. No.: 13/067,153

(22) Filed: May 12, 2011

(65) Prior Publication Data

US 2012/0288807 A1 Nov. 15, 2012

(51) Int. Cl.

| | |
|---|---|
| ***F23M 5/00*** | (2006.01) |
| ***F02C 7/24*** | (2006.01) |
| ***F23R 3/00*** | (2006.01) |

(52) U.S. Cl.

CPC ..... *F23R 3/002* (2013.01); *F23R 2900/00014* (2013.01)

(58) Field of Classification Search

CPC ..... F23F 2210/00; F23R 2900/00014; F23R 3/18

USPC ..... 431/114, 195–201; 60/725, 751, 756, 60/758, 804

See application file for complete search history.

(56) References Cited

U.S. PATENT DOCUMENTS

| | | | | |
|---|---|---|---|---|
| 2,681,102 | A * | 6/1954 | St John | 431/114 |
| 3,041,836 | A * | 7/1962 | Truman et al. | 60/725 |
| 3,064,424 | A * | 11/1962 | Tomlinson | F23R 3/08 60/756 |
| 4,409,787 | A | 10/1983 | Davi et al. | |
| 5,353,598 | A | 10/1994 | Huck et al. | |
| 6,923,002 | B2 | 8/2005 | Crawley et al. | |
| 7,114,321 | B2 | 10/2006 | Belsom et al. | |
| 7,568,349 | B2 | 8/2009 | Hadley | |
| 7,578,130 | B1 | 8/2009 | Kraemer et al. | |
| 7,735,601 | B1 | 6/2010 | Stieger et al. | |
| 8,408,004 | B2 | 4/2013 | Davis, Jr. et al. | |
| 2005/0022530 | A1 | 2/2005 | Belsom et al. | |
| 2005/0032014 | A1* | 2/2005 | Doebbeling et al. | 431/350 |
| 2005/0100846 | A1* | 5/2005 | Gutmark | F23R 3/286 431/159 |
| 2008/0053097 | A1 | 3/2008 | Han et al. | |
| 2009/0111063 | A1 | 4/2009 | Boardman et al. | |

(Continued)

FOREIGN PATENT DOCUMENTS

| | | |
|---|---|---|
| CN | 1580642 | 2/2005 |
| CN | 101922711 | 12/2010 |
| EP | 2187125 A1 | 5/2010 |

OTHER PUBLICATIONS

Search Report and Written Opinion from EP Application No. 12167387.5 dated Aug. 6, 2012.

(Continued)

*Primary Examiner* — Avinash Savani
*Assistant Examiner* — Vivek Shirsat
(74) *Attorney, Agent, or Firm* — Nixon & Vanderhye P.C.

(57) ABSTRACT

A dampener or resonator is provided within a combustor casing to mitigate combustion dynamics. The combustor casing head end volume is reduced by the resonator to mitigate combustion dynamics. The resonator is formed by a ring shaped plate that carries a continuous inwardly protruding wall or segmented inwardly protruding wall portions. The resonator can be a stand alone part that is inserted into the combustor casing or it can be integrally formed with the combustor casing.

12 Claims, 4 Drawing Sheets

(56) References Cited

U.S. PATENT DOCUMENTS

2010/0313568 A1 12/2010 Davis, Jr. et al.
2011/0005233 A1 1/2011 Sadig et al.

OTHER PUBLICATIONS

Office Action dated Mar. 13, 2015, issued in corresponding Chinese Application No. 201210158271.0 (6 pages).

* cited by examiner

COMBUSTOR CASING FOR COMBUSTION DYNAMICS MITIGATION

FIELD OF TECHNOLOGY

The subject matter disclosed herein generally relates to combustors. More particularly, the subject matter is directed to mitigation of combustion dynamics in combustors.

BACKGROUND

As emissions requirements for gas turbines have become more stringent, there has been a movement from conventional diffusion flame combustors to Dry Low NOx, (DLN) or Dry Low Emissions (DLE) or Lean Pre Mix (LPM) combustion systems. These DLN/DLE/LPM combustors use lean fuel air mixtures (equivalence ratio of 0.58 to 0.65) during fully premixed operation mode to reduce NOx and CO emissions. Because these combustors operate at such lean fuel/air (f/a) ratios, small changes in velocity fluctuations can result in large changes in mass flow and fuel air fluctuations.

The fluctuations can result in large variations in the rate of heat release and can result in high-pressure fluctuations in the combustion chamber. Interaction of the chamber acoustics, fuel/air fluctuation, vortex-flame interactions and unsteady heat release leads to a feed back loop mechanism resulting in dynamic pressure pulsations in the combustion system. This phenomenon of pressure fluctuations is called thermo acoustic or combustion dynamic instabilities. Combustion dynamics is a major concern in DLN/DLE/LPM combustors.

In the prior art, it has been suggested to mitigate combustion dynamics by providing a combustion liner cap assembly, and forming a second set of circumferentially spaced cooling holes through the cylindrical outer sleeve. Other prior art attempts to mitigate combustion dynamics include providing an external resonator, and active control by changing fuel flow.

SUMMARY

In order to mitigate combustion dynamics a steam injection combustor casing is utilized which includes a ring plate configured to reduce the volume of the casing. The ring plate within the casing acts as a dampener to reduce low frequency combustion dynamics. More particularly, the combustor casing head end volume is reduced by provision of the ring plate which carries inwardly protruding walls thereby forming an integrated dampener within the combustor casing.

In one exemplary implementation the ring plate carries a continuous inwardly protruding wall around the diameter of the ring plate. Other exemplary implementations include ring plates with discontinuous or segmented inwardly protruding wall portions or lobes of various shapes. For example the discontinuous or segmented inwardly protruding wall portions or lobes can be contoured, or triangular, etc.

In yet other exemplary implementations the casing is integrally formed with a ring having a continuous inwardly protruding wall or a ring having inwardly protruding wall segments. If inwardly protruding wall segments are integrally formed within the casing, the shape of the wall segment lobes can be contoured, or triangular, etc.

These and other advantages and features will become more apparent from the following description taken in conjunction with the drawings.

DETAILED DESCRIPTION

Figure 1:
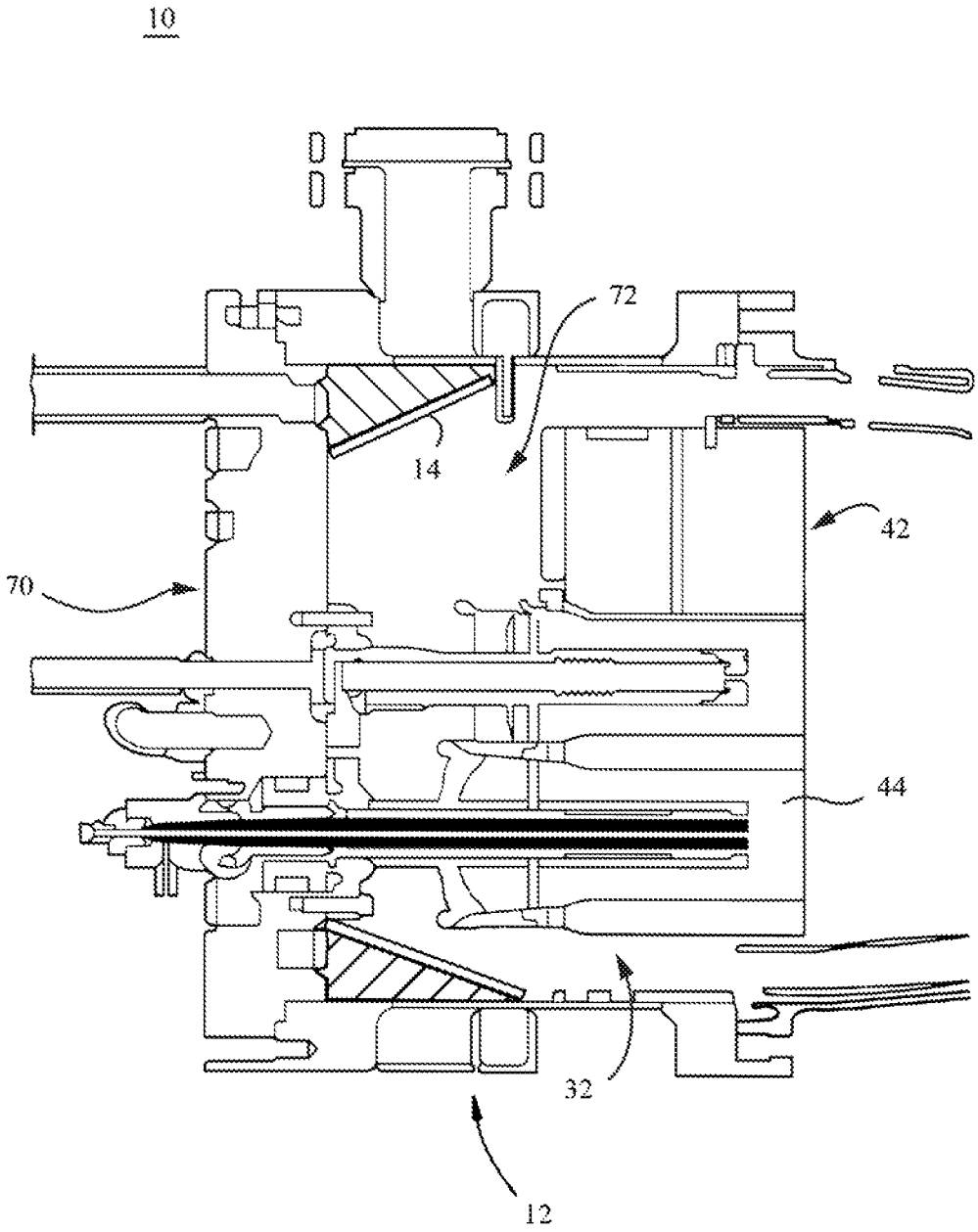
FIG. 1 is a cross section of the combustor casing illustrating an effective reduction in the volume of the combustor casing according to illustrative embodiments.

FIG. 1 shows a combustor 10 having a cylindrical combustor casing 12. Within combustor casing 12 are inwardly angled walls 14 which effectively reduce the volume of the combustor casing 12. More particularly, a head end volume 72 of the combustor casing 12 is reduced by provision of the inwardly angled walls 14. The inwardly angled walls 14 form a dampener which serves to mitigate combustion dynamics. By providing or forming the dampener 14 within combustor casing 12, economics in manufacture can be achieved by obviating the need for a separately provided external dampener.

Figure 2:
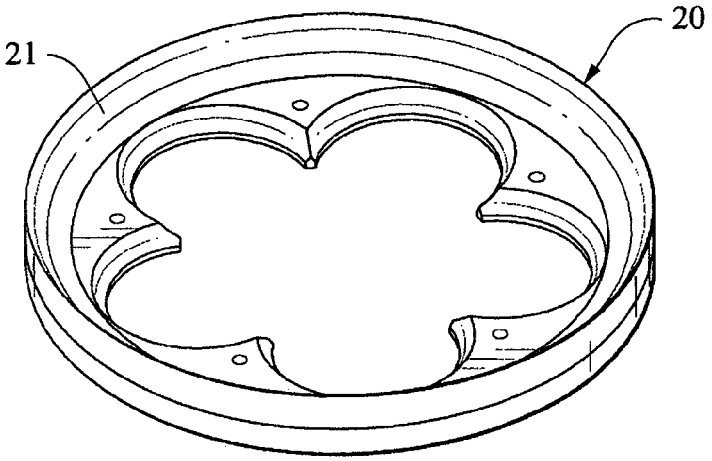
FIG. 2 shows an illustrative embodiment of the ring plate which effects the reduction in volume of the combustor casing as shown in FIG. 1.
Figure 3:
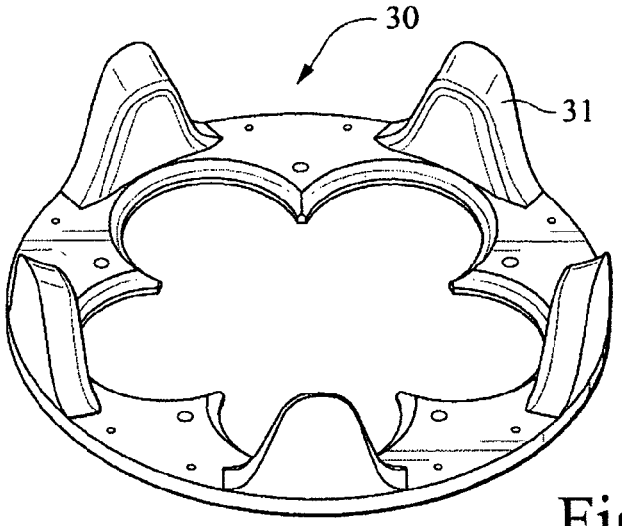
FIG. 3 shows another illustrative embodiment of the ring plate which effects the reduction in volume of the combustor casing as shown in FIG. 1.
Figure 4:
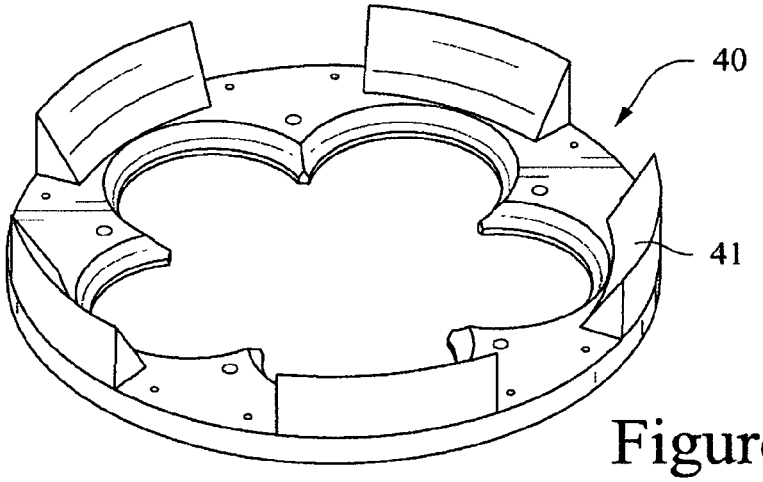
FIG. 4 shows yet another illustrative embodiment of the ring plate which effects the reduction in volume of the combustor casing as shown in FIG. 1.

FIGS. 2-4 show ring plates that carry continuous or segmented wall segments that reduce the volume within the combustor casing. More particularly, FIG. 2 shows ring plate 20 having a continuous inwardly angled wall 21 which serves to reduce the volume within the combustor casing when the ring is positioned or fixed within the combustor casing. FIG. 3 shows ring plate 30 having segmented and contoured lobes 31 which also serve to reduce the volume of the combustor casing when the ring is positioned or fixed within the combustor casing. FIG. 4 shows ring plate 40 having segmented and triangular lobes 41 which also serve to reduce the volume of the combustor casing when the ring is fixed within the combustor casing.

Figure 5:
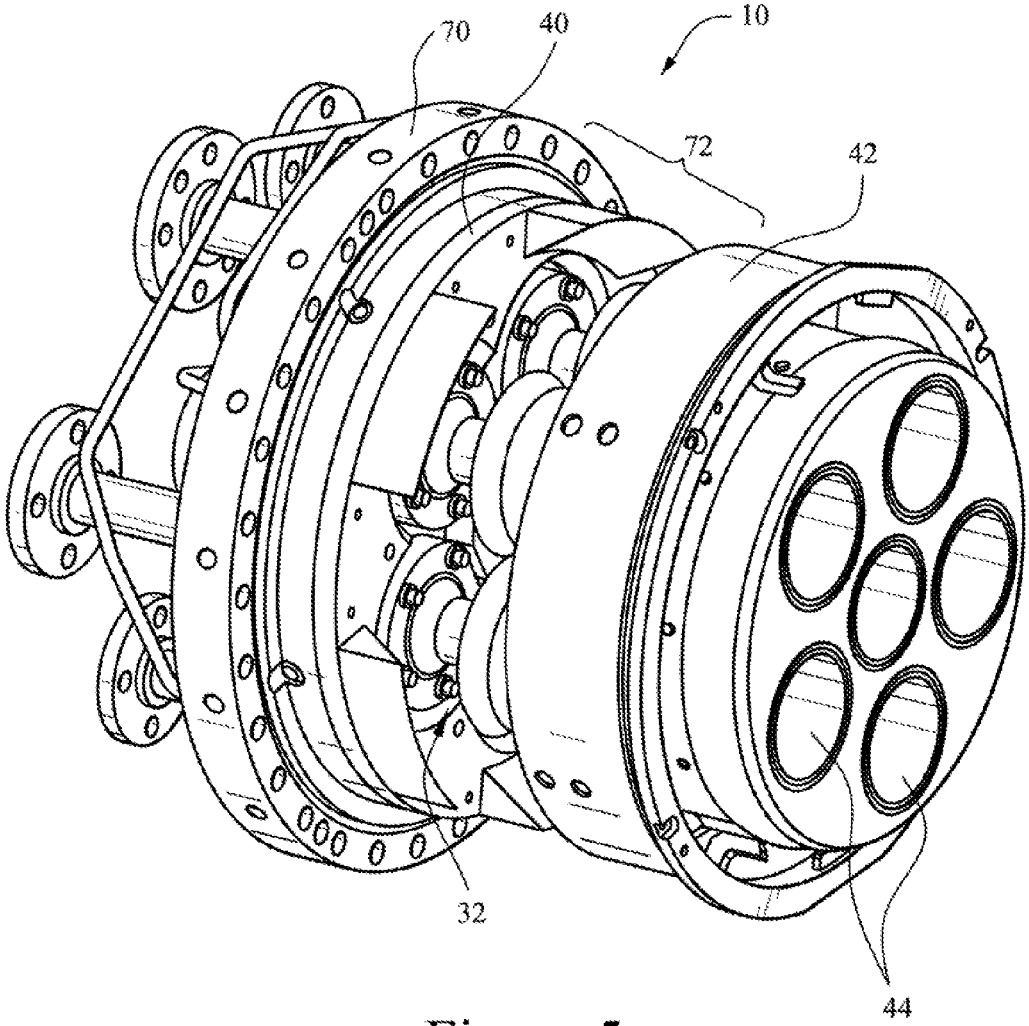
FIG. 5 is a perspective view of the ring plate shown in FIG. 4 provided in the combustor with the combustor casing removed.

FIG. 5 shows ring plate 40 of FIG. 4 installed in combustor 10 (the combustor casing having been removed to show installation of the ring plate). As shown in FIGS. 1 and 5, the rearward end of the combustion casing is closed by an end cover assembly 70 which may include conventional supply tubes for feeding gas, etc. to the combustor. The end cover assembly receives a plurality of fuel nozzle assemblies 32 arranged in a circular array about a longitudinal axis of the combustor. A combustion liner cap assembly 42 is arranged to communicate with the fuel nozzle assemblies 32. A plurality of fuel nozzle openings 44 is formed in the combustion liner cap assembly 42 as is conventional.

Figure 6:
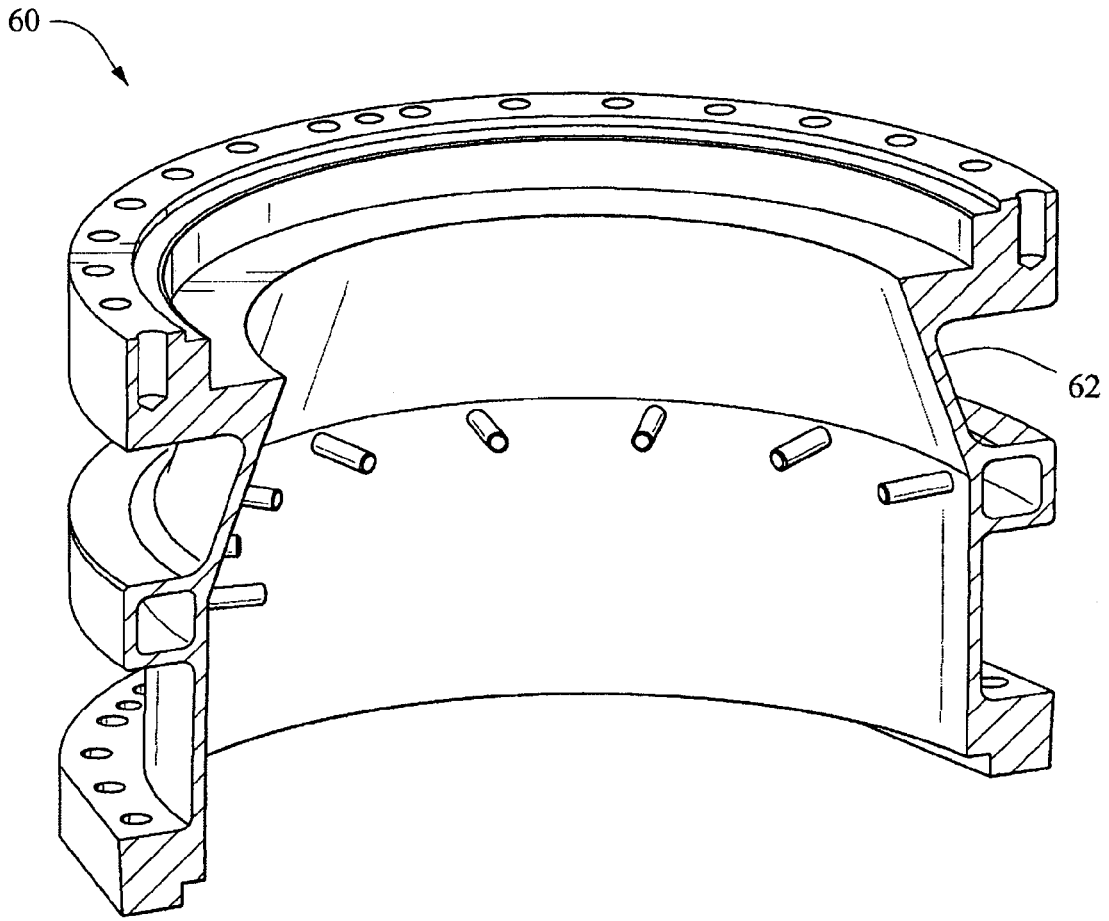
FIG. 6 shows an illustrative embodiment in which the ring plate shown in FIG. 2 is integrally formed within the combustor casing.

The ring plates 20, 30, and 40 have been shown as a separate part which allows for the retrofitting of existing combustors. However, an inwardly angled continuous wall 62 can also be integrally formed within the combustor casing 60, as shown in FIG. 6. As will be readily understood by those of ordinary skill in the art, the combustor casing can also be integrally formed with discontinuous wall segments (not shown) of various shapes. Any suitable casting method can be utilized for integrally forming the combustor casing with a continuous inwardly angled wall or wall segments.

This written description uses example implementations of apparatuses to disclose the inventions, including the best mode, and also to enable any person skilled in the art to practice the inventions, including making and using the devices or systems. The patentable scope of the inventions is defined by the claims, and may include other examples that occur to those skilled in the art. Such other examples are intended to be within the scope of the claims if they have structural elements or process steps that do not differ from the literal language of the claims, or if they include equivalent structural elements or process steps with insubstantial differences from the literal language of the claims.

What is claimed:

1. A combustor comprising:

a combustor casing including a cylindrical outer sleeve supporting internal structure therein, said cylindrical outer sleeve having inner and outer walls;

a ring-shaped member and at least a portion of inwardly angled smooth and solid wall thereon, said at least a portion of inwardly angled wall being continuously and outwardly tapered in the direction of mean flow, and both being fixedly positioned against the inner wall of said cylindrical outer sleeve and at the head end of said combustor casing upstream of the combustion chamber to form an integrated dampener within the internal volume of the combustor casing for reducing the internal volume of the combustor casing, said at least a portion of inwardly angled wall forming a resonator which mitigates combustion dynamics; and at least one fuel nozzle assembly, wherein the head end of the combustor casing is located upstream of the downstream end of the at least one fuel nozzle assembly, wherein the at least a portion of inwardly angled wall comprises discontinuous wall segments along the outer circumference of the ring-shaped member.

2. The combustor according to claim 1, wherein the wall segments have a contoured lobe shape.

3. The combustor according to claim 1, wherein the wall segments have a triangular lobe shape.

4. A combustor comprising:

a combustor casing including a cylindrical outer sleeve supporting internal structure therein;

at least a portion of inwardly angled smooth and solid wall, being continuously and outwardly tapered in the direction of mean flow and being integrally formed with the cylindrical outer sleeve and at the head end of said combustor casing upstream of the combustion chamber to reduce the internal volume of the combustor casing and thereby forms a resonator which mitigates combustion dynamics; and at least one fuel nozzle assembly, wherein the head end of the combustor casing is located upstream of the downstream end of the at least one fuel nozzle assembly, wherein the at least a portion of inwardly angled wall comprises discontinuous wall segments within the circumference of the combustor casing.

5. The combustor according to claim 4, wherein the wall segments have a contoured lobe shape.

6. The combustor according to claim 4, wherein the wall segments have a pyramidal lobe shape.

7. The combustor according to claim 1, wherein the at least one fuel nozzle assembly comprises a plurality of fuel nozzle assemblies.

8. The combustor according to claim 1, wherein the integrated dampener reduces a head end volume of the combustor casing.

9. The combustor according to claim 1, wherein said at least a portion of inwardly angled smooth and solid wall is positioned upstream of a combustion liner cap assembly.

10. The combustor according to claim 4, wherein the at least one fuel nozzle assembly comprises a plurality of fuel nozzle assemblies.

11. The combustor according to claim 4, wherein said at least a portion of inwardly angled smooth and solid wall reduces a head end volume of the combustor casing.

12. The combustor according to claim 4, wherein said at least a portion of inwardly angled smooth and solid wall is positioned upstream of a combustion liner cap assembly.

* * * * *